United States Patent [19]

Snyder

[11] Patent Number: 4,527,837

[45] Date of Patent: Jul. 9, 1985

[54] TUNNEL BORING MACHINE

[75] Inventor: Larry L. Snyder, Golden, Colo.

[73] Assignee: Harrison Western Corporation, Golden, Colo.

[21] Appl. No.: 461,683

[22] Filed: Jan. 27, 1983

[51] Int. Cl.[3] ..... E21C 29/02

[52] U.S. Cl. ..... 299/31; 175/61; 299/56

[58] Field of Search ..... 299/31, 56; 175/61, 175/76, 94

[56] References Cited

U.S. PATENT DOCUMENTS

| | | | |
|---|---|---|---|
| 3,061,288 | 10/1962 | Robbins | 299/31 |
| 3,345,108 | 10/1967 | Newman et al. | 299/31 |
| 3,920,277 | 11/1975 | Winberg et al. | 299/31 |
| 3,963,080 | 6/1926 | Walker | 299/31 |
| 4,185,873 | 1/1980 | Bohnes et al. | 299/31 |
| 4,312,541 | 1/1982 | Spurgeon | 299/31 |

FOREIGN PATENT DOCUMENTS

| | | | |
|---|---|---|---|
| 1534611 | 8/1969 | Fed. Rep. of Germany | 299/31 |

*Primary Examiner*—Stephen J. Novosad

*Assistant Examiner*—Mark J. DelSignore

*Attorney, Agent, or Firm*—Klaas & Law

[57] ABSTRACT

A tunnel boring machine for controlled boring of a curvilinear tunnel including a rotating cutter wheel mounted on the forward end of a thrust cylinder assembly having a central longitudinal axis aligned with the cutter wheel axis of rotation; the thrust cylinder assembly comprising a cylinder barrel and an extendable and retractable thrust arm received therein. An anchoring assembly is pivotally attached to the rear end of the cylinder barrel for anchoring the machine during a cutting stroke and providing a rear end pivot axis during curved cutting strokes. A pair of laterally extending, extendable and retractable arms are fixedly mounted at a forward portion of the cylinder barrel for providing lateral displacement in a laterally curved cutting mode and for anchoring the machine between cutting strokes and during straight line boring. Forward and rear transverse displacement and support assemblies are provided to facilitate cutting in a transversely curved cutting mode and to facilitate machine movement between cutting strokes.

10 Claims, 9 Drawing Figures

TUNNEL BORING MACHINE

BACKGROUND OF THE INVENTION

The present invention relates to tunnel boring machines and more specifically to a tunnel boring machine capable of boring a curvilinear tunnel with horizontally and vertically curved portions of relatively small radius as well as straight line portions.

Tunnel boring machines have long been used in the mining industry for the purpose of cutting generally straight line tunnels and tunnels with curves of large radius (500 feet) through earthen strata. The rock cuttings created by the machine in the boring process are generally removed from the area in which the machine is working by a conveyor or light rail system within the tunnel and moved rearwardly through the tunnel for subsequent transport to a materials handling area. A problem in the use of tunnel boring machines until the present invention has been that in following right of way boundaries or other mining layout plans, it is often necessary to provide for tunnel alignments with small radius curves. When a prior art type tunnel boring machine is used, it is therefore often necessary to periodically stop the machine boring operation and create an enlarged area at the tunnel end face through blasting, manual rock cutting, etc. so that the machine can be reoriented to produce a sharp deflection in the alignment of the tunnel.

It would be generally desireable to provide a tunnel boring machine having the capability of boring curves of small radius as well as curves of large radius and straight line tunnel portions. The machine should also be capable of cutting a relatively tight curve (50 feet) without the need for excessive manual labor operations or blasting at the tunnel face.

SUMMARY OF THE INVENTION

The tunnel boring machine of the present invention is a relatively short, light weight, and diametrically compact machine designed to have a very tight turning radius. The machine may be supplied with an ancillary power trailer that provides electrical and hydraulic power to the machine as well as other necessary back-up services.

The tunnel boring machine consists of two primary assemblies: an anchoring assembly and a working or moving assembly. The anchoring assembly supports total weight of the machine and counteracts thrust and torque produced while the machine is boring into the tunnel face. The anchoring assembly is composed of an elongated main body means which supports various machine components. The main body means is provided with a plurality of positioning means at the front and rear end portions which allow the longitudinal axis of the main body means to be oriented in any desired position with respect to the longitudinal axis of the tunnel.

For purposes of reference herein, the tunnel direction extending perpendicular to the tunnel longitudinal axis in a horizontal plane is referred to as the lateral direction and a line intersecting the tunnel longitudinal axis and extending in the lateral direction is referred to as a tunnel lateral axis. The tunnel direction extending from the tunnel roof to the tunnel floor which, in horizontal tunnel portions, is a vertical direction, is referred to as a transverse direction and a line intersecting the tunnel longitudinal axis and lateral axis and perpendicular to both is referred to as the tunnel transverse axis. Of course, each tunnel section will have a separate set of longitudinal and transverse axes which may or may not be parallel to the lateral and transverse axes of other tunnel sections depending upon the curvature of the tunnel.

The longitudinal axis of the tunnel boring machine lies generally in a direction parallel to the tunnel longitudinal axis but is variable in alignment with respect thereto for the purpose of creating a curved tunnel. A forward portion of the main body means has forward lateral positioning means mounted thereon which, in the preferred embodiment, comprise opposed extendable and retractable forward lateral arm means fixedly attached to the body means. Similarly, the rear end portion of the machine has lateral positioning means mounted thereon which in the preferred embodiment comprise opposed, extendable and retractable, rear lateral arm means. However, the rear lateral arm means are pivotally mounted on the body means whereby the body means may be pivoted in a lateral plane with respect to the rear lateral arm means.

The machine is also provided with forward transverse positioning means which act in a direction parallel or slightly inclined with respect to the direction of gravity depending upon the tunnel boring mode and tunnel portion in which the machine is operating. In a preferred embodiment, the forward transverse positioning means comprises an extendable and retractable leg means which is fixedly attached to a forward portion of the body means and extends from the lower surface thereof. The forward lateral arm means and forward transverse leg means may comprise a generally T-shaped configuration. A rear transverse positioning means is also provided and may be an extendable and retractable rear support wheel means mounted at the rear end portion of the body means below the lateral arm means. Each of the lateral arm means and the forward transverse leg means is provided with pivotal gripping shoe means at the end thereof which allow the arms or leg to pivot with respect thereto, and visa versa, when the gripping shoes are pressed into engagement with the tunnel side walls.

In the preferred embodiment of the invention, the laterally extending rear arm means are always extended into wall gripping relationship with the tunnel side walls during a cutting stroke. A machine rear end pivot point located at the intersection of the machine longitudinal axis and rear lateral arm axis is always fixed with respect to the tunnel side walls. Depending upon the mode of operation of the tunnel boring machine, the machine body may pivot about the rear pivot point in various pivotal planes. The front lateral arms and front transverse leg may be extended or retracted to produce the displacement which causes pivoting of the main body in the various modes of operation. However, in straight ahead boring, all of the positioning means maintain a fixed relationship with the tunnel side walls and no pivotal movement takes place.

The working assembly of the tunnel boring machine comprises cutter wheel means, thrust arm means, and drive motor means. The thrust arm means is mounted in coaxial alignment with the main body means which also serves as the machine longitudinal thrust cylinder. A main bearing means at the end of the main body means accept the thrust arm means in annular sliding relationship and supports the weight of the cutting wheel means which is transmitted thereto along the surface of the thrust arm means. The thrust arm means is extendable and retractable within the thrust cylinder means and in the preferred embodiment is operated by a conventional hydraulic system. The cutter wheel is rotated about an axis coaxial with the thrust arm longitudinal axis by drive means which in the preferred embodiment comprise direct drive electric motors and multiple stage gear reducers driving a common ring gear. The ring gear is fixedly mounted on the cutter wheel means.

The cutter wheel means has a dome shaped forward face with rolling disc cutter devices mounted thereon. As the cutter wheel means rotates and forward thrust force is applied, the cutter devices penetrate the rock in circular kerfs, causing the rock to spall and fall to the tunnel floor. As the cutter wheel means turns, muck buckets mounted on the rim of the wheel pick out the cut material and deposit it on machine conveyor means which pass it to the rear of the machine where it is transferred to a trailing conveyor, muck train or other handling system.

The machine is advanced between cutting strokes by stopping rotation of the cutting wheel and lowering the front end portion of the machine until the cutting wheel rests on the tunnel floor. The rear support wheel means then may be extended to support the rear end of the main body means and to facilitate subsequent forward movement. The rear lateral arm means are retracted after extension of the rear support wheel. The main body is then pulled forward towards the cutting wheel by retraction of the thrust arm. After the forward movement of the main body means is completed the various positioning means may be extended to realign the main body means within the tunnel for the next cutting stroke.

It is among the objects of the present invention to provide a tunnel boring machine which may be used to cut a tunnel having straight line portions, vertically curved portions, and horizontally curved portions.

It is a further object of the present invention to provide a tunnel boring machine which may cut relatively tight radius curves.

It is a further object of the present invention to provide a tunnel boring machine which is pivotal in multiple planes about a fixed rear pivot point during a cutting stroke.

It is a further object of the invention to provide a tunnel boring machine having a central longitudinal axis which may be shifted as well as pivoted with respect to the tunnel longitudinal axis during boring operations.

It is a further object of the present invention to provide a tunnel boring machine which may be advanced between cutting strokes through operation of its thrust cylinder means.

It is a further object of the invention to provide a tunnel boring machine with integral muck removal means.

It is a further object of the invention to provide a tunnel boring machine which may be equipped with dust shield and dust removal means.

It is a further object of the invention to provide a tunnel boring machine which is short, light weight, diametrically compact, safe to use, and efficient to operate.

BRIEF DESCRIPTION OF DRAWING

An illustrative and presently preferred embodiment of the invention shown in the accompanying drawings wherein.

DETAILED DESCRIPTION

Figure 1:
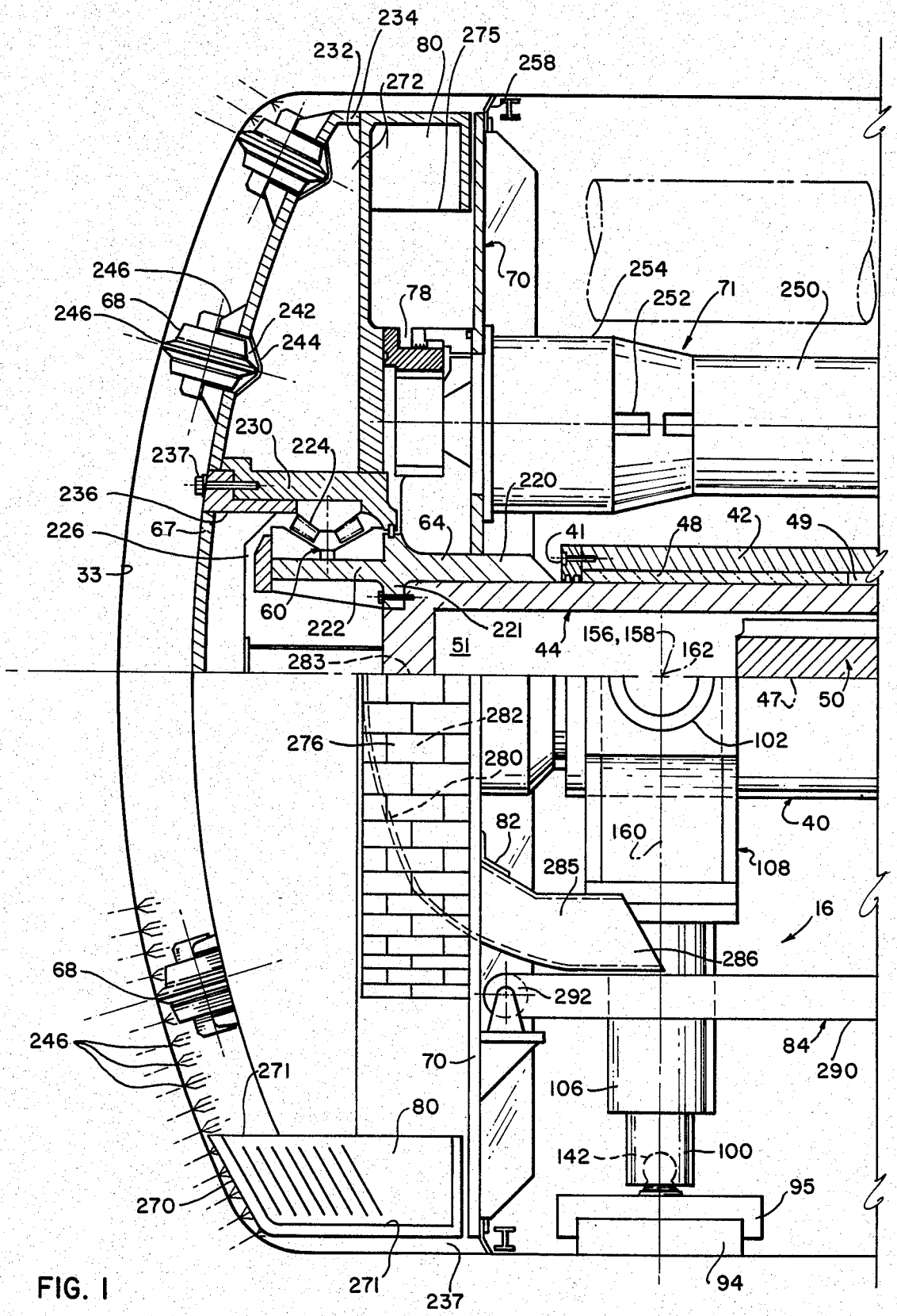
FIG. 1 is a cross-sectional side elevational view of a front portion of a boring machine of the present invention in operating position in a tunnel.

In general, the machine 30 of the present invention is constructed and arranged to cut an annular elongated tunnel 31 having a central longitudinal axis 32, a plurality of lateral axes 41, a plurality of transverse axes 45, an end face 33 which is cut away by the machine to elongate the tunnel, and an annular side wall 34 which includes a roof portion 35, a floor portion 36 and opposite side wall portions 37, 38.

Figure 2:
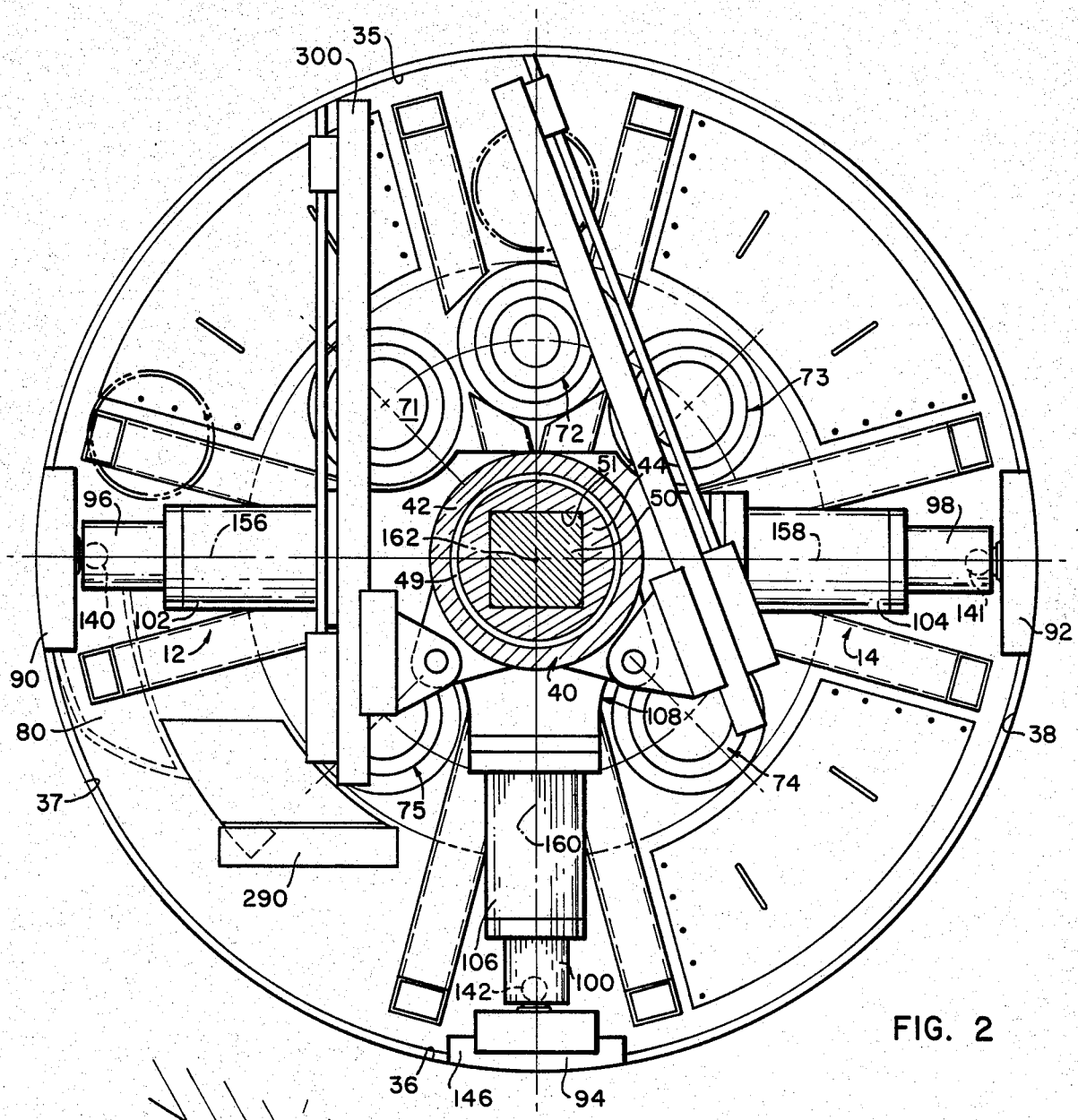
FIG. 2 is a cross-sectional of the machine taken along line 2—2 in FIG. 1A.
Figure 8:
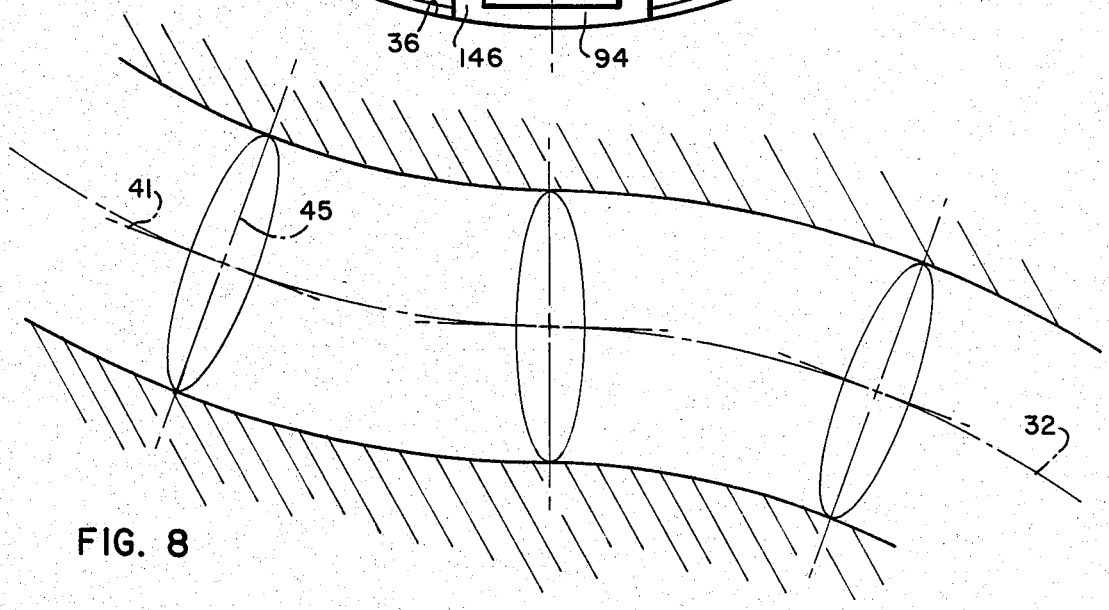
FIG. 8 is a perspective transparent view of a tunnel cut by a boring machine of the present invention.

The machine comprises a relatively short length (e.g., approximately 15–18 feet) fluid operated thrust cylinder means 40, including an outer cylinder barrel member 42 and an inner piston rod member 44 having a piston sliding seal portion 46 at the rear end thereof, which define a central longitudinal machine axis 47. An elongated cylindrical bearing means 48 is mounted in the front end portion of cylinder member 42 to enable relative axial sliding movement between the cylinder and the piston rod and define a variable volume fluid chamber 49 on the front side of piston portion 46. An elongated torque shaft means 50. having a polygonal cross-sectional configuration (FIG. 2) is axially slidably and non-rotatably mounted in a bore 51 of corresponding cross-sectional configuration in piston rod member 44.

An enlarged rear end portion 54 of torque shaft means 50 has an annular bore 56 for fixedly receiving the rear end portion 58 of cylinder member 42 and providing a rear end wall 60 of cylinder means 40 defining a variable volume fluid chamber 62 at the rear side of piston portion 46.

A hub means 64 is fixedly attached to the front end of piston rod member 44 for axial movement therewith. A cutting wheel means 66 having a dome shape end plate 67 carrying a plurality of radially and circumferentially spaced cutting devices 68, is rotatably mounted on hub means 64 by bearing means 224 for rotation relative to thrust cylinder means 40, about axis 47. An annular motor support plate means 70 is fixedly mounted on hub means 64 for supporting a plurality (e.g., five) circumferentially spaced drive motor means and planetary gear box means 71, 72, 73, 74, 75 for causing rotation of cutting wheel means 66 through pinion gear means 76 operatively associated with a drive ring gear means 78 fixedly attached to cutting wheel means 66. A plurality of circumferentially spaced muck bucket means 80 are mounted on the outer periphery of cutting wheel means 66 to carry cuttings to the top end of a vertical extending chute means 82 located between support plate means 70 and cutting wheel means 66. A muck conveyor means 84 is located beneath chute means 82 for conveying cuttings toward the rear of the machine.

A plurality of extendable and retractable gripping pad means 90, 92, 94 are mounted on piston rod means 96, 98, 100 of circumferentially spaced fluid operable power cylinder means 102, 104, 106 fixedly mounted on a mounting bracket means 108 fixed on the front end portion of thrust cylinder member 42. A plurality of variably extendable and retractable tunnel side wall gripping pad means 110, 112 are mounted on piston rod means 114, 116 of oppositely spaced axially aligned, fluid operable power cylinder means 118, 120 fixedly mounted on a pivot plate means 122 pivotally mounted by a pin means 124 between clevis plate portions 126, 128 on the rear end portion of torque shaft means 50. An extendable and retractable tunnel floor engaging support wheel means 130 is pivotally mounted on piston rod means 132 of a fluid operable power cylinder means 134 fixedly attached to the rear end portion of torque shaft means 50. Each of the pad means is connected to its associated piston rod means by a spherical ball joint means 140, 141, 142, 143, 144 to enable limited universal movement therebetween. Bottom pad means 94 is also slidably mounted in a support bracket 146. Each rear horizontal cylinder means 118, 120 is rotatable relative to its associated piston rod means 114, 116 about a lateral axis 146. The longitudinal machine center axis 47, rear vertical pin pivot axis 125 and rear horizontal cylinder pivot axis 146 intersect at a point 150 which is coincident with a vertical plane including the axis of rotation 154 of wheel 130. The central axes 156, 158 of horizontal front pad cylinders 102, 104 are coaxial and in the same vertical plane as central axis 160 of lower front pad cylinder 106 so as to intersect central machine axis 47 at a point 162.

The construction and arrangement of the machine is such as to enable four separate modes of operation, i.e., (1) straight line boring, (2) lateral (horizontal) offset curve boring, and (3) transverse (vertical) offset curve boring, and (4) combined lateral transverse spiral offset curve boring.

Thrust Cylinder Means

As illustrated by FIGS. 1, 1A, 2, and 3 a thrust cylinder means 40 is provided for forcing the cutting wheel means against the tunnel face to provide cutting pressure. The thrust cylinder means 40 comprises elongated cylindrically shaped cylinder barrel member 42 having a longitudinal axis which defines the machine longitudinal axis 47, which, in the presently preferred embodiment, may have a length on the order of 10 feet and a diameter on the order of 2 or 3 feet. The cylinder barrel member 42 has a cylindrical cavity 43 extending therethrough which allows the mounting of a cylindrical piston rod member 44 therein. The diameter of the piston rod member 44 is slightly less than the diameter of the barrel cavity 43 except for the rear most portion thereof 46 which comprises annular seal means 48 which slidingly and sealingly engage the interior wall of the barrel member 42. The diameter differential between the piston outer surface and the cylinder barrel inner surface creates an annular cavity between the two surfaces. The forward portion of the annular cavity if filled by an elongated cylindrical bearing means 48 which maintains the opposed surfaces of the cylinder barrel member 42 and piston rod member 44 in spaced apart sliding relationship. The bearing means 48 may be a bushing constructed from any number of conventional materials well known in the art and is maintained within the barrel member 42 by an end cap 41 conventionally attached to the forward end of the cylinder barrel 42 in sealing relationship with the piston outer surface. The portion of the annular cavity positioned rearwardly of the bearing means 48 defines a variable volume fluid chamber 49 which extends rearwardly and terminates at the enlarged piston end portion 46. Orifice means (not shown) positioned in communication with the fluid chamber 49 near the bearing means 48 are conventionally ported to allow in flow and discharge of pressurized hydraulic fluid to and from fluid chamber 49.

Piston rod member 44 has an elongate bore 51 therein which has a polygonal cross-section throughout at least a portion of its length. The bore 51 accepts a similar polygonal shaped torque shaft means 50 in close slideable relationship therein. The polygonal shape of the bore 51 and torque shaft means 50 prevents rotational motion of the torque shaft means 50 relative the piston rod member 44. The torque shaft means has an enlarged end portion 54 which in turn comprises an annular bore 56 in the forward face 57 thereof for fixedly receiving the rear end portion 58 of the cylinder barrel 42 in sealed relationship therewith. The forward face 57 of the enlarged rear end portion 54 also provides a rear end wall 60 for terminating the rearward end of cavity 43. A variable volume fluid chamber 62 is defined by the space between the rear surface 63 of piston member 44 and end wall 60. Conventional orifice means (not shown) allow in flow and discharge of pressurized hydraulic fluid into fluid chamber 62 for causing movement of the piston member 44 within the barrel member 42. Thus, it may be seen that piston member 44 is reciprocally mounted within barrel means 42. The piston member 44 may be extended by in flow of hydraulic fluid into chamber 62 with simultaneous discharge of hydraulic fluid from chamber 44 and may be retracted by in flow of hydraulic fluid into chamber 49 and discharge from chamber 62 in a conventional manner well known in the art.

The torque shaft means 50 comprises upper and lower clevis plate portions 126, 128 at the enlarged rear end portion 54 thereof as discussed in further detail hereinafter.

Cutting Wheel Mounting Means

Cutting wheel mounting means such as hub means 64 are provided at the forward end of piston rod member 44 and allow the cutting wheel means 66 to be mounted in rotational relationship with the piston rod member 44 with the axis of rotation thereof in coaxial alignment with longitudinal machine axis 47. The hub means 64 comprises a generally cylindrical body portion 220 having an inner cylindrical sidewall which engages the outer surface of the piston rod member 44 in annular abutting contact. Radially inwardly projecting flange portion 221 is accepted by an annular shoulder portion at the terminal end of piston rod member 44 and is fixedly attached thereto as by bolts or the like whereby the hub means 64 is affixed in non-rotatable relationship with the piston rod member 44. An axially extending cylindrical flange portion 222 extends from cylindrical body portion 220 in an axially forward direction and provides a surface for supporting a portion of bearing means 224 which in the preferred embodiment may comprise double roll double tapered bearing means used in a conventional manner to rotatably support cutting wheel means 66 as described in further detail hereinafter. A bearing retaining ring 226 may be provided to retain the bearing means 224 in proper relationship with the hub means 64 and cutting wheel means 66.

Cutting Wheel Means

Cutting wheel means 66 is rotatably mounted on the hub means 64 for rotatably engaging the tunnel face 33 and causing the cutting removal of material therefrom to elongate the tunnel. The cutting wheel means 66 comprises a cylindrical sleeve 230 which extends axially in concentric relationship with hub means 64 and is rotatably mounted thereon by the bearing means 224. A radially extending annular support plate 232 is fixedly mounted in annular relationship about the rear most portion of cylindrical sleeve 30 as by weldment or the like. A convex generally dome-shaped end plate 67 having an axially extending annular flange 234 at the periphery thereof is fixedly mounted on the periphery of annular support plate 232 by weldment or other conventional attachment means. Cylindrical sleeve 230 extends axially to the rearward surface of dome-shaped plate 67 to which it is fixedly attached as by axially extending attachment plate 236 and/or bolts 237, etc. Various other structure support members (not shown) may also be provided between sleeve means 230, annular plate means 232 and dome-shaped end plate 67 to further strengthen the cutter wheel means 66. Thus, it may be seen that the cutter wheel means 66 is rotatably mounted on hub means 64 and is thus rotatable with respect to thrust cylinder means 40 about the longitudinal axis 47 thereof.

The cutter wheel means may have entry means therein to permit workers to climb through the wheel from the rear side to the forward side to replace cutter devices 68, etc. The entry means may comprise hinged plates 231, 233, 235 or other access areas in the various cutter wheel surfaces.

Cutting Devices

The cutting wheel means 66 comprises a plurality of cutting devices 68 mounted thereon for engaging and spalling the surface of tunnel face 33 causing rock cuttings to be removed therefrom. The cutting devices may be mounted on the surface of plate 67 by welded brackets 240 or the like above cut-out portions 242 in the dome plate 67. The cut-out portions 242 may be sealed to prevent rock cutting debris from entering through the opening into the rearward portion of the wheel as by sealing plate members 244. The cutting devices 68 are rotatable about axes positioned generally tangentially with respect to the surface of dome shaped plate 67 and lying within radially extending planes containing central machine axis 47. Thus, the cutting device cutting surfaces 246 roll in the direction of circular movement of the cutting wheel means 40. The use of roller type cutting devices to spall the surface of a rock face is well known in the mining arts.

Figure 5:
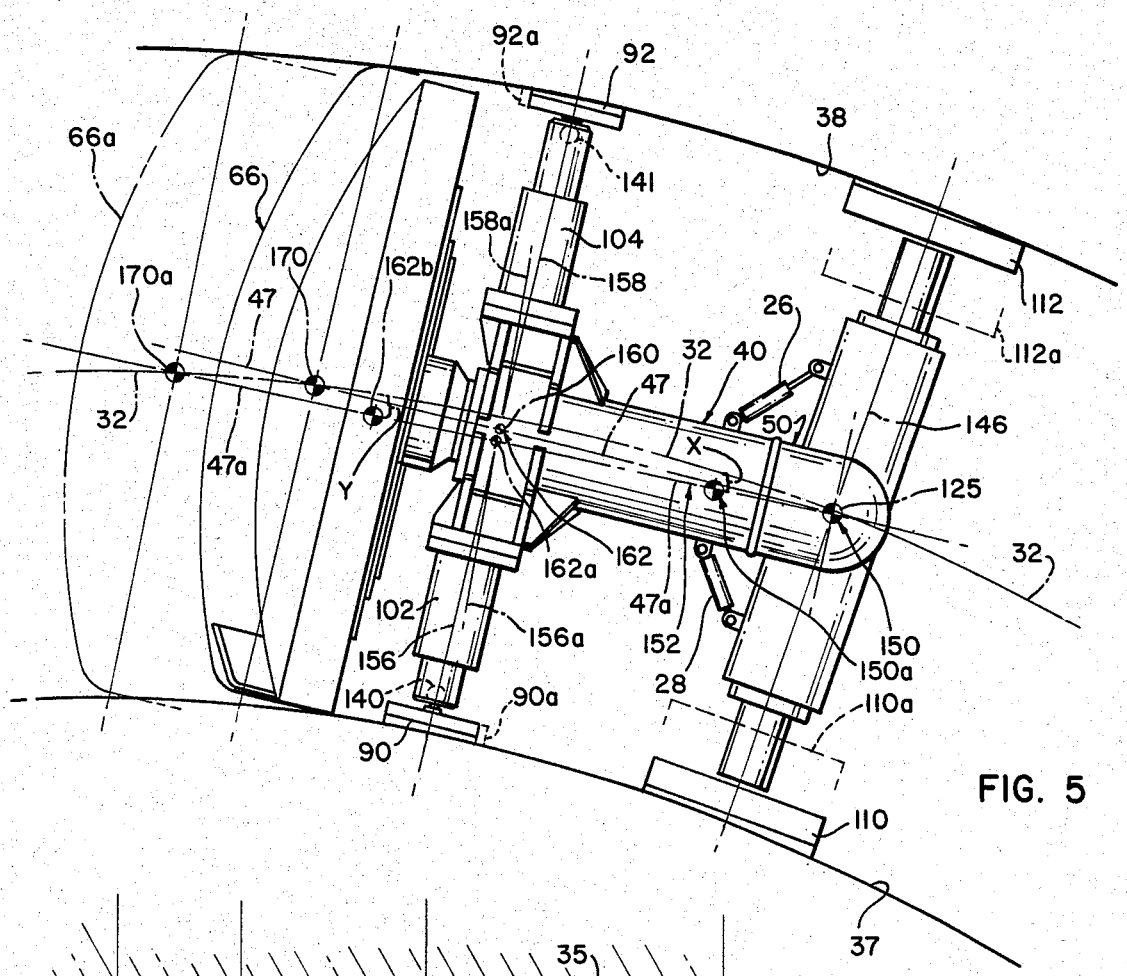
FIG. 5 is a plan view of the machine in a horizontally curved portion of a tunnel.
Figure 7:
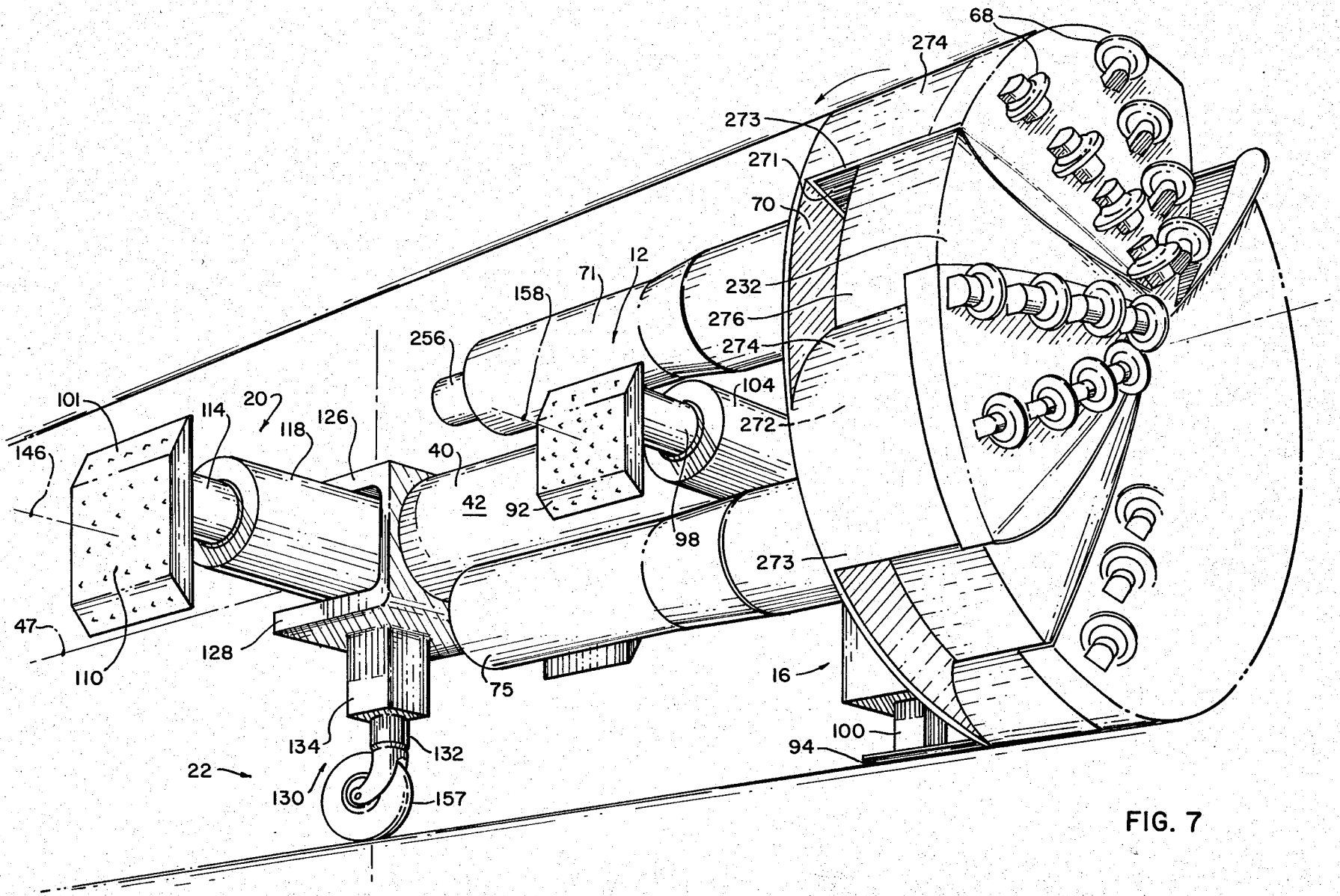
FIG. 7 is a perspective view of a boring machine of the present invention.

The cutting devices are positioned at spaced apart intervals on the plate means 67 as shown in FIGS. 1, 5 and 7 at a spacing whereby the cutting edges 246 cut radially spaced apart grooves in the tunnel end face to cause spalling of the rock. In the presently preferred embodiment the spacing between grooves is on the order of $3\frac{1}{2}$"-4" near the center portion of plate 67 and decreases as the cutters are located outwardly to a spacing on the order of 1" at the outer periphery (gage area). The outer most cutting edges 246 are positioned at a distance slightly more radially remote than the cutting wheel annular flange portion 234 and are positioned at a cutting angle of approximately 70° with respect to the axis of rotation due to the curve shape of the dome plate 67. This cutting angle at the peripheral edge allows the cutting wheel to be advanced in a direction slightly offset with respect to its axial alignment when lateral and/or transverse pressure is exerted upon it. Such pressure may be provided by the forward lateral cylinder means 102, 104 or by forward transverse cylinder means 106 or by the force of gravity depending upon the machine cutting mode.

Drive Motor Means

An axially extending motor support plate means 70 is fixedly attached to the body portion 220 of hub means 64 as by weldment or the like and thus supports motor means 71–75 in rotationally fixed relationship with respect to the thrust cylinder means 40. In the preferred embodiment, five motor means, 71–75, are positioned in equally spaced circumferential relationship about the support plate means 70 at a distance of approximately half the distance to the circumferential perimeter thereof. The drive motor means comprise elongate axially extending housings 250. The motor means may comprise axially extending drive shafts 252 which are connected with suitable reduction gear means 254 for transmitting rotational motion to pinion gear means 76 positioned on the forward side of annular support plate means 70. Pinion gear means 76 in turn engage drive ring gear means 78 which is fixedly mounted on the rear surface of cutting wheel support plate 232 by conventional mounting means. Thus, rotation of the pinion gear 76 by the drive motor means 71–75 causes relative rotational movement of the ring gear means 78 and the attached cutting wheel means 66 relative to the motor means and thrust cylinder means 40.

A positioning motor 256 may be mounted on one or more of the motor means 71 through 75 at the rear end thereof in operable connection with the motor drive shaft 252 for the purpose of slow controlled rotation of the drive shaft 252. The slow rotation of the drive shaft by the positioning motor 256 is used to adjust the angular position of the thrust cylinder means 40 with respect to the cutting wheel means 66 for the purpose of placing the thrust cylinder means in proper angular rotational alignment with the lateral and transverse axes of the tunnel. Another function of the positioning motor 256 is to controllably change the angular position of the cutter wheel to position the entry means at the tunnel floor to allow workers to enter through the wheel as previously discussed and to further move the wheel if necessary to facilitate cutter device removal and replacement.

Dust Seal Means

The annular motor support plate means 70 extends radially outwardly into near touching engagement with the tunnel side wall surface 34. A flexible axially extending dust seal means 258 may be mounted at the outer periphery of the annular support plate means 70 for the purpose of sealing the forward portion of the tunnel containing the cutter wheel means with respect to the rearward portion of the tunnel to prevent dust and debris from entering the rear portion of the tunnel.

Muck Removal Means

Muck removal means are provided on machine 30 for removing rock cuttings spalled free by the cutting devices at the front face 33 of the tunnel. The muck removal means comprise muck bucket means 80 as illustrated in FIGS. 1, 2, 3, and 7 positioned in spaced-apart relationship at the periphery of the cutting wheel means 66. The muck buckets have a scoop-like shape with a mouth opening 271 therein positioned toward the direction of rotational movement of the cutting wheel means. The mouth opening communicates with an axially extending cavity 272 which extends from the front end 273 to the rear end 274 of the bucket means. The axially extending cavity 272 also communicates with a second radially inwardly directed opening 275. Thus, rock cuttings entering mouth opening 271 are transmitted by centrifugal force and the slope of the bucket inner walls through cavity 272 in an axially rearward direction to a position adjacent opening 275. As the bucket rotates upwardly past a point approximately 90° from the bottom most position the shape of the bucket inner walls near the axially rearward radially inwardly directed opening 275 is such that the rock cuttings begin to fall out of opening 275. A muck ring 276 is provided in annular enclosing relationship about the motor pinion gears and ring gear to prevent the rock cuttings and associated dust and debris from coming into contact therewith and also for the purpose of providing a surface for deflecting rock cuttings into associated conveyor means 84. The muck ring 276 is fixedly attached to nonrotating plate member 70 and slidingly sealingly engages the rear surface of rotating plate member 232 by conventional rotating seal means well known in the art. A muck chute means 82 is positioned on the lateral side of the cutter wheel means associated with upward movement of the muck buckets (the right side facing forward in the machine illustrated in FIG. 1). The muck chute means 82 has a generally transversely extending portion 280 positioned in abutting contact with muck ring 276 and extending generally laterally outwardly and radially rearwardly therefrom to form an enclosure 282 defined by chute portion 280 and associated portions of muck ring 276 and plate 70. The enclosure 282 has an opening 283 at the top which accepts rock cuttings dumped from the muck bucket means 80 as they are rotated upwardly above opening 283. The rock cuttings are transported through chute portion 80 by the force of gravity and pass through an opening in plate 70 into rear chute portion 285 and out chute opening 286 onto conveyor means 84.

The rock cuttings, upon being discharged from chute means 82 are carried by conveyor means 84 rearwardly for deposit in the tunnel haulage system or another conventional transport means for later removal from the tunnel. The conveyor means may comprise a generally horizontally extending conveyor belt 290 supported on a plurality of conveyor rolls 292 and driven by a drive roll 294. The forward most conveyor rolls may in turn be supported on annular motor support plate 70 at a position immediately below chute means 82 and a rearward portion of the conveyor may be supported by a rear portion of the machine 30. Much removal systems are well known in the art.

The muck removal means may provide an access means to the front of the cutter wheel means for cutting device replacement, etc. when the wheel is stopped. Other access means such as hatches, etc., may also be provided.

Forward Positioning Means

Lateral and transverse thrust cylinder positioning means are fixedly attached to the forward portion of thrust cylinder outer cylinder member 42 for the purpose of slidingly guiding or steering or slidingly supporting or fixedly supporting the forward portion of the thrust cylinder means with respect to the tunnel sidewall 34.

Forward lateral positioning means may comprise opposite laterally extendable and retractable forward arm means 12, 14 which may comprise laterally extending coaxial power cylinder means 102, 104, mounted as by mounting bracket means 108 on the forward end of thrust cylinder barrel member 42. Each cylinder 102, 104 has conventional extendable and retractable piston rod means 96, 98 mounted therein and each piston rod means in turn has a gripping pad means 90, 92 mounted in swiveling relationship on the terminal end thereof as by spherical ball joint means 140, 141. The piston arms 96, 98 may be extended along forward coaxial lateral axes 156, 158 which are perpendicular to and intersecting with longitudinal machine axis 47. The piston arms 96, 98 may be extended to bring plates 90, 92 into gripping relationship with the tunnel lateral sidewall portions 37, 38 to prevent linear displacement of the cylinder barrel 42 with respect to the sidewalls. This wall gripping engagement position is utilized during the cutting stroke in straight ahead tunnel boring as opposed to curved tunnel boring.

The piston arms 96, 98 may also be extended equally to bring the gripping pad means 90, 92 into sliding, nongripping relationship with the lateral portions of the sidewall whereby the forward portion of the thrust cylinder barrel 42 may be maintained in a laterally centered position with respect to the tunnel wall. This piston position is used in vertically curved boring where the longitudinal machine axis 47 is pivoted about lateral rear axis 146, discussed in further detail hereinafter.

The piston arm may also be operated independently, one being extended while the other is retracted, to cause a lateral displacement at the forward end of thrust cylinder barrel 42. This mode of operation is used in horizontally curved tunnel boring during the cutting stroke to cause the forward end of the barrel 42 to be "steered" laterally about rear transverse axis 125. Pivotal motion of the pad means 90, 92 with respect to the terminal end of the piston means 96, 98 facilitated this result allowing forward lateral axis 156, 158 to be oriented at a slight angle with respect to the lateral axis of the tunnel portion in which it is positioned.

Forward transverse positioning means may comprise forward extendable and retractable transverse leg means 16. The leg means 16 may comprise transverse power cylinder means 106 fixedly attached as by bracket means 108 to the forward portion of thrust cylinder means cylinder barrel 42. Transverse power cylinder means 106 may have its transversely aligned central axis 160 positioned in intersecting and perpendicular relationship to both longitudinal axis 47 and forward lateral axes 156, 158. The forward lateral and transverse axes may thus intersect the longitudinal axis 47 at a common point 162 located in a forward interior portion of thrust cylinder means 40.

The forward transverse power cylinder means 106 has a conventional piston rod means 100 extendably and retractably mounted therein and axially moveable along forward transverse axis 160. A pad means 94 is swivelly mounted at the terminal end of piston 100 as by ball joint means 142 whereby the piston means 100 and operably attached cylinder means 106 and bracket 108 are rendered freely rotatable about forward transverse axis 160 as required for horizontally curved boring. Gripping pad means 94 is provided with a slide means such as laterally slideable slide plate 95 which allows the terminal end of piston means 100 to be slidingly displaceable with respect to the pad means 94 in a lateral direction to facilitate lateral shifting movements of the machine during horizontally curved boring. The piston rod 100 may be extended or retracted from cylinder 106 to raise or lower the forward portion of the thrust cylinder relative the longitudinal axis 32 of the tunnel. The forward transverse leg means 16 also provides vertical support to the forward portion of the thrust means which holds the cutting wheel means 66 off the tunnel floor during most boring operations. In boring applications in gravitational fields having a force similar to that of the earth, usually only a single transverse positioning member is required, since the weight of cutting wheel means 66 acts to urge the forward end of the machine downwardly when vertical support of the forward transverse cylinder means 106 is removed. However, in cutting applications in relatively low force gravitational fields, or in cutting extremely hard materials, an upper forward transverse positioning means (not shown) may be required. Such a device might, in an alternate embodiment with necessary motor repositioning, comprise a diametrically opposed cylinder means (not shown) of the same or identical construction as cylinder means 106 for urging the forward end of the thrust cylinder means, and thus cutting wheel means 66, downwardly.

The gripping pad means 90, 92, 94 provided at the end of piston means 96, 98, 100 may comprise a high strength steel plate or the like having a thickness on the order of 6 or 8 inches and having a substantially square cross-section with a dimension of between 1 and 2 feet on a side. The wall gripping surface of each gripping pad means may have a curved or beveled outer surface to accommodate the curvature of the tunnel sidewall 34 and may also comprise raised projections 101 to increase gripping effectiveness.

Rear Positioning Means

Figure 3:
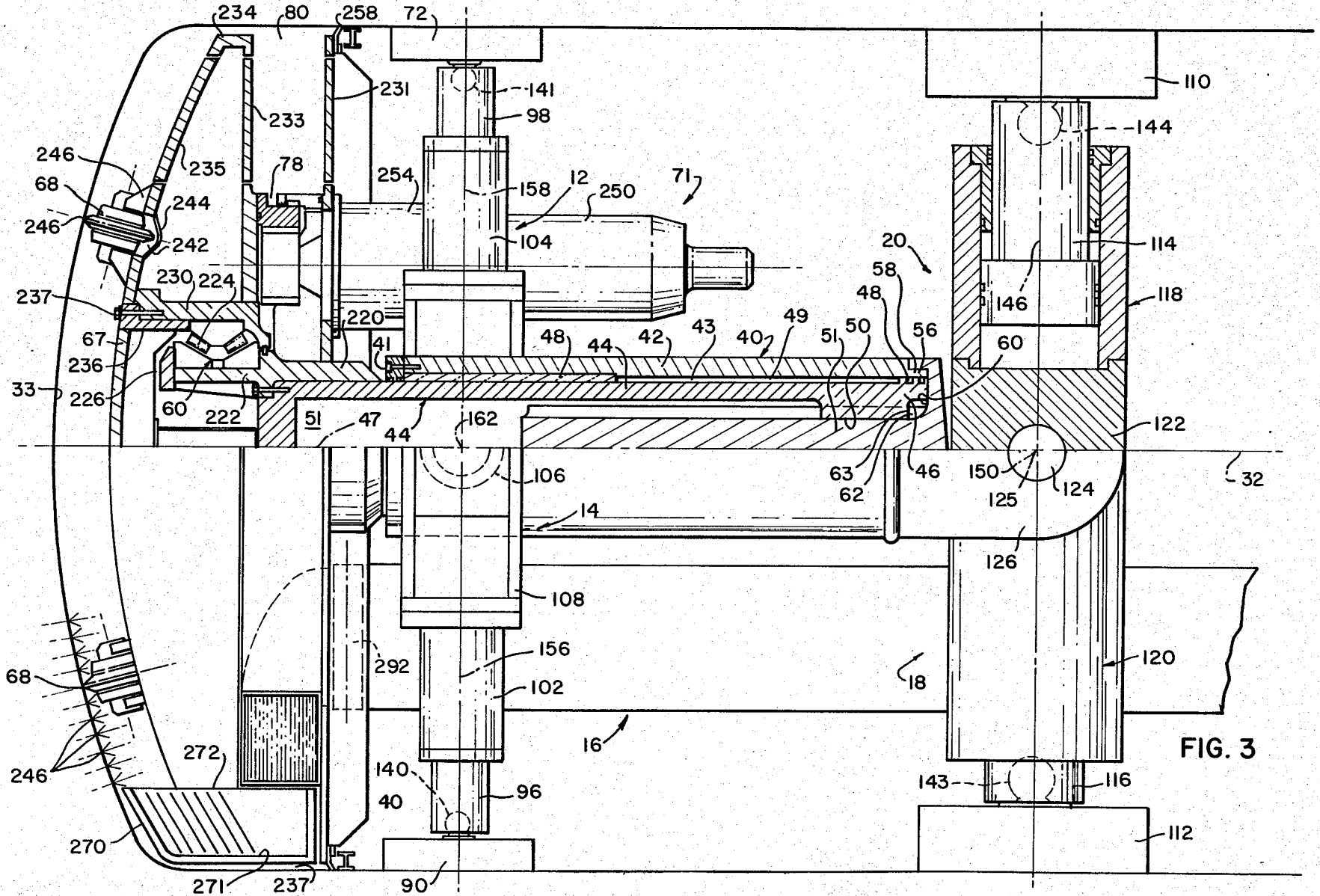
FIG. 3 is a top view of the machine.

Machine 30 is provided with lateral and transverse rear positioning means mounted on the rear surface of cylinder means 40 for selectively positioning the rear end portion of the machine 30 within the tunnel and to fixedly hold the rear portion of the machine in gripping, linearly non-displaceable contact therewith during certain cutting operations. The thrust cylinder means is also held in nonrotatable relationship relative machine axis 47 by the rear positioning means. As illustrated by FIG. 3 rear transverse positioning means such as rear extendable and retractable transverse arms 18, 20 are provided as by coaxial fluid operable power cylinder means 118, 120 positioned in coaxial alignment with transverse lateral axis 146 positioned in coplanar relationship with longitudinal axis 47 and forward lateral axes 156, 158 and angularly displaceable therewith. Each power cylinder means 118, 120 comprises a conventionally extendable and retractable piston arm 114, 116 mounted therein and axially extendable along rear lateral axis 146. The terminal end of each piston rod 114, 116 is in turn swivelly attached to rear gripping pad means 110, 112 as by ball joints 143, 144. Cylinder means 118, 120 are fixedly attached at the inwardly positioned ends thereof to a pivot block means 122 pivotally mounted about rear transverse axis 125 defined by transverse pivot pin 124 which is in turn fixedly mounted between clevis portions 126, 128. The pivot block means 122 extends transversely from clevis plate portion 126 to clevis plate portion 128 whereby it is pivotable only about transverse pivot pin axis 125. Thus it may be seen that the central axis 146 of cylinder means 118, 120 may be pivoted to various angular positions relative longitudinal axis 47. The swivel mounting of the gripping pad means 110, 112 relative the piston rods 114, 116 also allow the entire cylinder means 118, 120 to be rotatable about axis 146. Cylinder means 118, 120 and associated gripping pad means 110, 112 may provide all the gripping force used to prevent rearward movement of the machine 30 during a cutting stroke and thus are substantially larger than forward cylinder means 102, 104 and associated gripping pad means 90, 92. The piston rods 114, 116 are selectively extendable whereby the position of rear transverse axis 125 may be shifted laterally relative the tunnel center line 32 as needed during various for centering operations prior to a new cutting stroke. Thus, it may be seen that the rear lateral positioning means may be used to shift the rear end portion of the cylinder means 40 relative the tunnel sidewalls and the transverse pivotal connection of the cylinder means 118, 120 allows the center line 47 of the machine to be angularly displaced in a lateral plane relative the center line 32. The swiveling attachment of the pistons 114, 116 to the gripping pad means 110, 112 allows angular displacement of the machine central longitudinal axis 47 in a transverse plane relative the tunnel longitudinal axis 32.

Figure 1A:
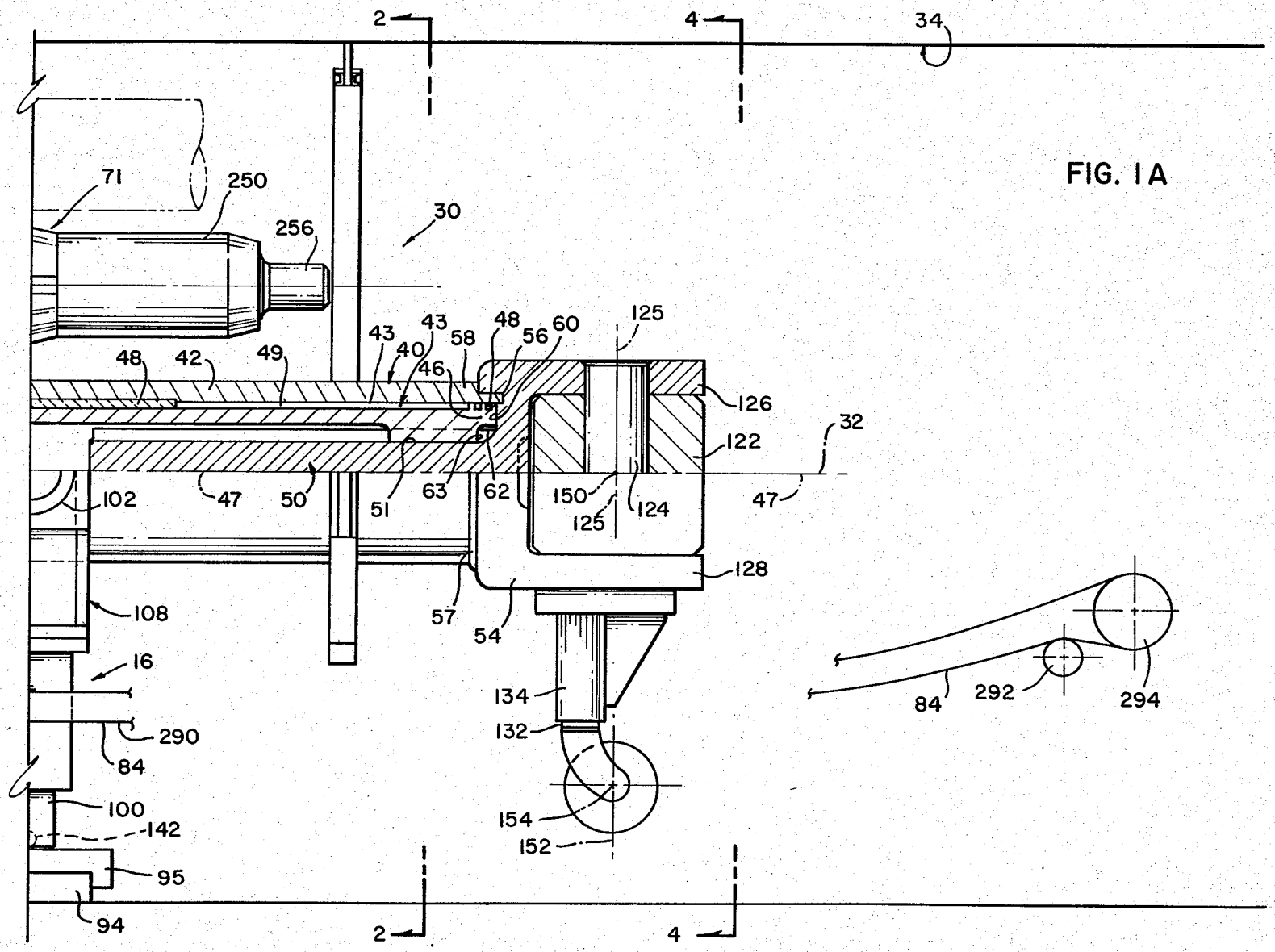
FIG. 1A is a cross-sectional side elevation view of a rear portion of the machine of FIG. 1 in operating position in a tunnel.
Figure 4:
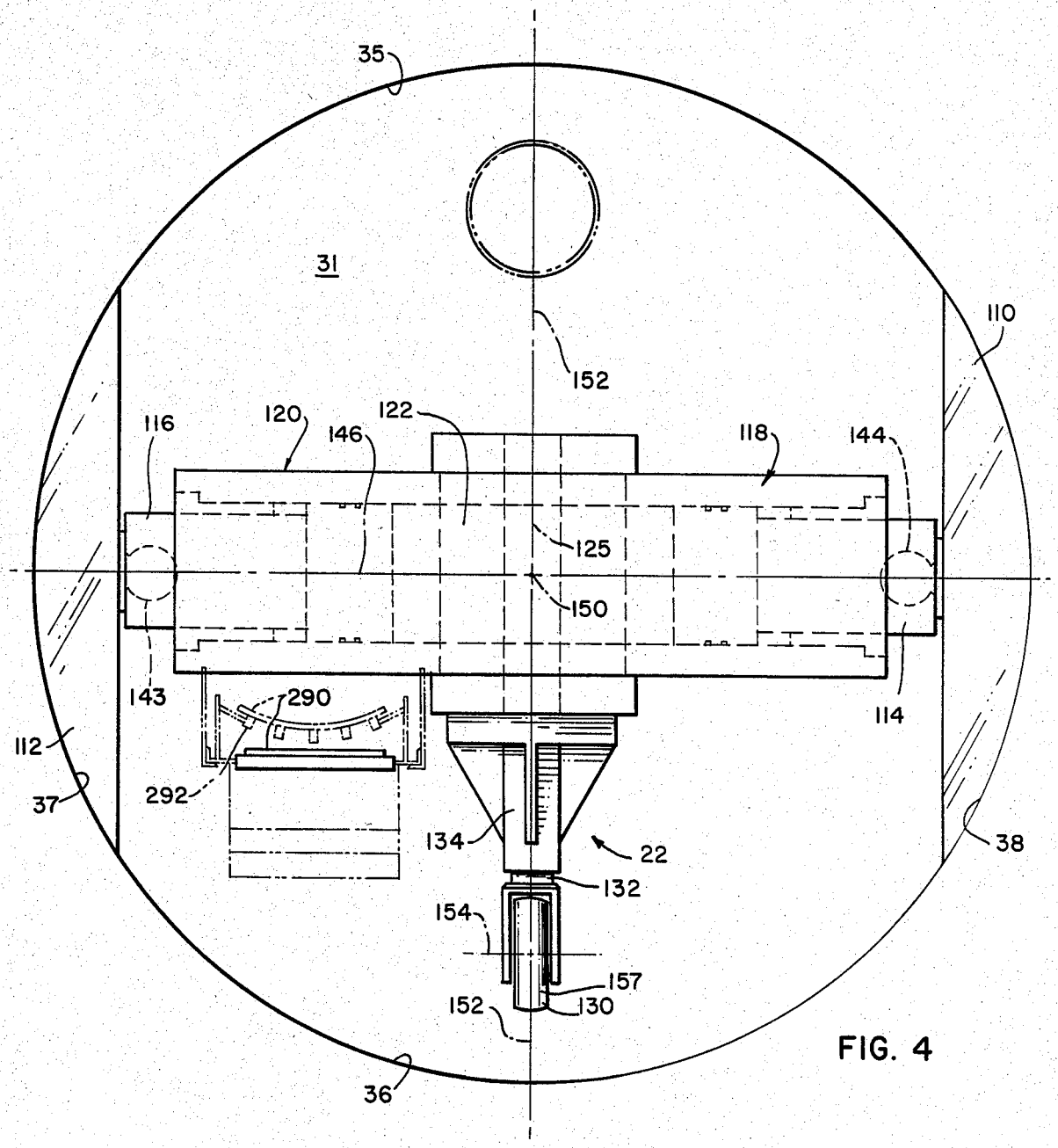
FIG. 4 is a cross-sectional view of the machine taken along line 4—4 in FIG. 1A.

A rear transverse positioning means 22, FIG. 1A, 4, is provided in axial alignment with rear transverse axis 125 as by tunnel floor engaging support wheel means 130 extendably and retractably mounted on power cylinder means 134 by support wheel piston rod means 132. The transversely aligned power cylinder means 134 is fixedly attached to the lower surface of clevis plate portion 128 by conventional attachment means such as weldment or the like. Support wheel means 130 may comprise a caster wheel means whereby the axis of rotation 154 of the wheel 157 is freely rotatable about the transverse axis 152. The support wheel means 130 may be extended into engaging contact with tunnel floor 136 to provide rear support for the machine when gripping means 110 and 112 are disengaged from the sidewall. The support wheel means 130 also facilitates forward movement of the rear portion of the machine during the retraction of piston rod member 44 in thrust cylinder means 40 between cutting strokes. The support wheel 130 may also be aligned with its axis 154 in a longitudinal direction to facilitate relative angular movement about the machine axis 47 in an adjustment mode to bring transverse axis 52 into alignment with the surrounding gravitational field.

Adjusting means such as hydraulic cylinder means, 26, 28, FIG. 3, etc., or may be mounted between cylinder means 116, 118 and cylinder barrel 42 to align axis 146 in perpendicular relationship with tunnel axis 32 and/or machine axis 47 at the beginning of each new cutting stroke. The rear cylinder means axis 146 is positioned in perpendicular relationship with both the longitudinal tunnel axis 32 and the longitudinal machine axis 47 in the straight line and vertically curved boring modes. In the horizontally curved boring mode, however, axis 146 is positioned perpendicular to axis 32 but not to machine axis 47 once curved tunnel cutting bias commenced since axis 47 is nonaligned with axis 32 during horizontally curved boring.

Control Means

Conventional hydraulic control means well known in the art may be provided to actuate the various hydraulic cylinder devices described herein to perform the various operations described herein. Similarly, conventional electrical motor controls and hydraulic motor controls may be conventionally provided to control the various drive motors and positioning motor described herein.

Operation

In each mode of operation, (1) straight line boring, (2) lateral (horizontal) offset curve boring, and (3) transverse (vertical) offset boring, and (4) combined lateral and transverse offset curve (spiral) boring, the rear center point 150 of the machine is located and held at approximately the central longitudinal axis 32 of the portion of the tunnel, whether straight or curved, where the rear lateral cylinder means 118, 120 have been relocated after retraction of the thrust cylinder means 40 at the end of each cutting stroke. The front center point 170 of the cutting wheel is initially located at approximately the central longitudinal axis 32 of the portion of the tunnel near the tunnel end face 33. Center point 170 is at a position on the longitudinal axis 47 which is intersected by a line drawn through diametrically opposed points at the outer peripheral cutting edge portion of the cutting wheel means.

In straight line boring, the central machine axis 47 will be coaxially aligned with the central tunnel axis 32 during each cutting stroke. In curved line boring, the position of the central machine axis 47 relative to tunnel centerline 32 rear pivot point 150 is gradually changed during each cutting stroke so that, at the end of a stroke, the central machine axis is in a different non-aligned position relative to its position at the start of a cutting stroke. The gradual change in position of the machine axis 47 is accomplished by pivotal movement thereof about fixed rear point 150. The pivotal movement about rear point 150 may take place in a vertical plane about lateral pivotal axis 146 or it may take place in a horizontal plane about transverse pivotal axis 125 or both pivotal motions may take place simultaneously. Thus, at the start of any cutting stroke in any mode of operation, the central rear pivot point 150 and front alignment point 170 are first located at substantially the central longitudinal axis of the associated portion of the tunnel and rear point 150 is fixed by rear cylinder means 118, 120. Then the various front cylinder means 102, 104, 106 are operable in various manners to effect the different modes of operation.

In order to enable both horizontal and vertical offset curve boring, the machine is provided with an arrangement of pivotal support means providing a plurality of pivotal axes enabling universal relative movement between various portions of the machine.

In all modes of operation, the rear pad means 110, 112 and associated cylinder means 118, 120 act as fixed tunnel wall gripping means during each cutting stroke. During any cutting stroke cylinder means 118, 120 are aligned with axis 146 in perpendicular alignment with the tunnel axis 32. This alignment may be made by actuation of adjustment means 26, 28. In the straight line mode of operation, the front pad means 90, 92, 94 and associated cylinder means 102, 104, 106 also act as fixed tunnel wall gripping means during each cutting stroke. In the horizontal curve mode of operation, the front pad means 90, 92 and associated cylinder means 102, 104 act as guide and steering means while front pad means 94 with slide means 95 and associated cylinder means 100 act as laterally movable load support means. In the vertical curve mode of operation, the front horizontal pad means 90, 92 act only as guide means and front vertical pad means 94 and cylinder means 106 act as steering and support means.

In the straight line mode of operation, all pad means are clampingly engaged with the tunnel wall during the cutting stroke. At the end of the cutting stroke, the front clamping pad means are retracted to lower the cutting wheel means onto the tunnel floor or other support means. Then the rear wheel 130 is lowered into engagement with the tunnel floor to support the rear end portion of the machine. Then the rear clamping pad means are retracted. Next, hydraulic fluid is applied to the front chamber 49 of thrust cylinder means 40 and exhausted from the rear chamber 62 to retract piston rod member 44 into barrel member 42 whereby the cylinder barrel member 42 is moved forwardly on the piston rod portion 44 toward the cutting wheel means 66. The cutting wheel means 66 remains in stationary contact with the tunnel floor 36 during the forward movement of cylinder barrel 42. Then the rear wheel cylinder means 134 is actuated to raise or lower the rear end portion center point 150 of the machine to approximately the same height as the associated portion of tunnel central axis 32. Then the rear clamping pad means are extended laterally into engagement with the tunnel side walls 37, 38 to laterally position the center point 150 at the tunnel central axis 32. Then the front vertical support cylinder means 106 is actuated to lift the cutting wheel means to the horizontal cutting position with front center point 162 located approximately the same height as the tunnel axis 32. Then the front horizontal cylinder means 102, 104 are extended into engagement with the tunnel side wall to laterally position center point 162 at the tunnel axis 32. Then all clamping and support cylinders may be further adjusted if necessary to obtain exact alignment of the machine axis 47 with the central longitudinal tunnel axis 32. Then all clamping cylinders means are actuated to provide fixed clamping engagement with the tunnel side wall.

Figure 6:
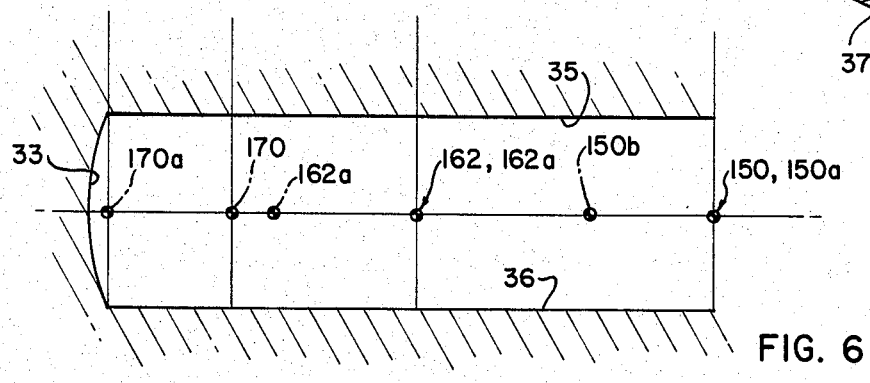
FIG. 6 is a schematic side elevational view of FIG. 5.

In the horizontal offset curved mode of operation, as illustrated in FIGS. 5 and 6, the central longitudinal axis 32 of the tunnel is curved. Only the rear clamping pad means 110, 112 are fixedly engaged with a rearward portion of the curved tunnel side walls 37, 38 during the cutting stroke with cutting wheel means 66 being moved forwardly and laterally to position **66*a*. Front horizontal pad means 90, 92 act as a steering means and are slidably guideably engaged with a forward portion of the curved tunnel side walls 37, 38. The distance between each of the pad means 90, 92 and machine front center point 162 is variable during the cutting stroke by actuation of cylinder means 102, 104 to gradually change the location of machine axis 47 by pivotal movement about rear center point 150 and vertical axis 125 toward side wall 37 which places the machine axis 47 in a laterally rotated position 47*a* at the end of the cutting stroke. During the cutting stroke, front cylinder means 104 is slowly laterally outwardly extended and front cylinder means 102 is simultaneously moved laterally inwardly. The pivotal movement of the thrust cylinder means 40 produced by this extension and retraction of cylinder means 102, 104 causes a rearward shifting of pad means 90 to position 90***a* and a forward shifting of pad means 92 to position 92*a*. The front cylinder axes 156, 158 are thus shifted to locations 156*a*, 158*a*. Front pad ball joint connecting means 140, 141, 142 enable relative angular displacement between pad means 90, 92 and 94 and associated cylinder means 102, 104 and 106. Slide means 95 provided on lower front pad means 94 enables lateral pivotal shifting movement of cylinder means 106 about pivot axis 125. Thus, center point 170 on the cutting wheel means 66 is moved along the curved central longitudinal tunnel axis 32 to position 170*a* by the lateral movement of front cylinder means 102, 104 and the forward extension of thrust cylinder piston means 44. At the end of the stroke, the rear wheel means 130 is lowered to support the rear end portion of the machine, the rear clamping pad means 110, 112 are retracted to positions 110*a*, 112*a*, the front pad means 90, 92 and 94 are retracted, and the rear portion of the machine is moved forwardly to the next stroke start position along machine axis 47*a* to locate rear center point at 150*b* and front center point at 162*b* as previously described. After the rear portion of the machine is moved forwardly along machine axis 47*a*, rear center point 150*b* and front center point 162*b* will be laterally offset from central curved longitudinal axis 32 by distances "X" and "Y". Prior to the start of the next stroke, axis 146 is aligned perpendicular to axis 32 by adjustment means 26, 28, and the center points 150*b*, 162*b* are located in proper vertical and horizontal starting relationship to tunnel axis 32 by actuation of cylinders 102, 104, 106, 118, 120 134, then cutting is continued along the desired path.

As illustrated in FIGS. 5 and 6, rear end center point 150 (150*a*) is held in a fixed position on axis 32 during the extension portion of the cutting stroke and is moved to 150*b* in substantially horizontal and vertical alignment with the curved central longitudinal tunnel axis 32 during the thrust cylinder forward movement. Front end center point 160 is located in substantially vertical alignment with curved central tunnel axis 32 and is variably laterally offset to point 160*a* during the cutting stroke and remains laterally offset at 160*b* after movement of cylinder 40. After the rear end portion of the machine is moved forwardly at the end of a cutting stroke, rear center point 150*b* is laterally offset from curved central longitudinal tunnel axis 32 and may also be slightly vertically offset relative thereto. Thus, at the end of the forward movement of the rear end portion, the rear center point must be relocated at the central longitudinal axis 32 by actuation of rear cylinder means 118, 120, 134 and adjustment means 26, 28. In this manner, a relatively tight radius tunnel turn (e.g. 50 foot radius) may be cut.

In the vertical offset curve mode of operation, the rear end portion of the machine is laterally clamped to opposite side wall portions 37, 38 as previously described. The front end of the machine is slidably guided by front horizontal pad means 90, 92 which are extended to a fixed position in closely spaced non- clamping engagement with the tunnel side wall portions 37, 38. During forward movement of the cutter wheel means, the vertical extension of the front vertical support cylinder means 106 is continuously varied, either upwardly or downwardly, depending upon the direction that the tunnel is to curve. Actuation of vertical support cylinder means 106 causes pivotal movement of the thrust cylinder means 40 about lateral pivotal axis 146. At the end of each cutting stroke, the rear end portion of the machine is advanced and reset as previously described.

The vertical offset curve mode of operation may be combined with the horizontal offset curve mode of operation to cut a spiral tunnel curving in both a horizontal and a vertical direction. In one embodiment in either the horizontal or the vertical offset curve mode, the angle of displacement of machine central longitudinal axis 47 at the end of the cutting stroke from its position at the beginning of the cutting stroke is approximately 3°-5° in a machine approximately 18 feet long with a cutting wheel diameter of approximately 12 feet and having a 3 foot center of radius of curvature of dome is rear pivot point in closed position in this embodiment.

It is contemplated that the inventive concepts herein described may be variously otherwise embodied and it is intended that the appended claims be construed to include alternative embodiments of the invention except insofar as limited by the prior art.

What is claimed is:

1. An elongated tunnel boring machine, having a central longitudinal machine axis, for boring a linear tunnel section in a linear boring mode of operation or a curvilinear tunnel section in a curvilinear boring mode of operation; the tunnel having an end face and a peripheral side wall including a floor portion, a ceiling portion, and opposite side wall portions spaced from a central longitudinal tunnel axis; and the tunnel boring machine comprising:

rotatable cutting wheel means at the front end of the machine and having a central axis of rotation which is coaxial with the central longitudinal machine axis and adapted to be selectively located at a desired position approximately at the laterally opposite portion of the central longitudinal tunnel axis and held against the tunnel face during rotation for cutting material away from the tunnel face to elongate the tunnel and extend the central longitudinal tunnel axis in a selected direction;

motor means operatively connected to said rotatable cutting wheel means for selectively causing rotation thereof in a cutting mode of operation and stopping rotation thereof in a non-cutting mode of operation;

extendable and retractable thrust means, including a forwardly extending piston-rod means positioned substantially coaxially with said central longitudinal machine axis operably connected to said cutting wheel means and a rearwardly extending cylinder means positioned coaxially with and operably supporting said forwardly extending piston-rod means, for selectively causing forward movement of said cutting wheel means against the tunnel face in the cutting mode of operation during a cutting stroke said thrust means being selectively operable to cause forward relative axial movement between said piston-rod means and said cylinder means along the central longitudinal machine axis from a retracted position to an extended position to move the cutting wheel means forwardly relative to said thrust means during a cutting stroke in the cutting mode of operation and from the extended position to the retracted position to move said thrust means forwardly relative to said cutting wheel means in the non-cutting mode to prepare the machine for the next cutting stroke;

extendable and retractable rear end clamping and positioning means for fixedly locating and holding the rear end portion of the machine between opposite tunnel side wall portions with the rear end portion of the central longitudinal machine axis located in approximately coaxial relationship with the laterally adjacent portion of the central longitudinal tunnel axis in the linear boring mode and with the rear end portion of the central longitudinal machine axis located in approximately intersecting relationship with the laterally adjacent portion of the central longitudinal tunnel axis in the curvilinear boring mode, and being selectively movable between outwardly extended engaging positions and inwardly retracted non-engaging positions relative to the tunnel wall to facilitate repositioning of the machine between cutting strokes;

pivotal connecting means between said rear end clamping and positioning means and the rear end portion of the machine to provide at least one fixed rear end pivotal axis which is stationary relative said extendable and retractable rear end clamping means and the tunnel sidewall during a cutting stroke which intersects the central longitudinal machine axis for enabling the central longitudinal machine axis to be laterally pivotally displaced relative to the central longitudinal tunnel axis about said fixed rear end pivotal axis during a cutting stroke in the curvilinear boring mode of operation; and extendable and retractable front end clamping and positioning means fixedly attached to said cylinder means for fixedly locating and holding the front end portion of the machine between the opposite tunnel side wall portions with the central longitudinal machine axis located in approximately coaxial fixed relationship with the central longitudinal tunnel axis in the linear boring mode, and for adjustably locating and holding the front end portion of the machine between opposite tunnel sidewall portions during a cutting stroke with the portion of the central longitudinal machine axis located at said front end clamping and positioning means being in variably displaced, laterally offset relationship with the central longitudinal tunnel axis of the last bored tunnel portion in the curvilinear boring mode by lateral displacement of a forward portion of the machine by said front end clamping and positioning means.

2. A tunnel boring machine for controlled boring of an elongated curvilinear tunnel in earthen strata, the tunnel having a central longitudinal axis, and having tunnel cross sections perpendicular to the central longitudinal axis, the tunnel cross sections having a lateral axis oriented generally perpendicular to the direction of gravitational force and intersecting the central longitudinal axis and having a transverse axis intersecting the central longitudinal axis and the lateral axis and perpendicular to both, the tunnel having an end face and a peripheral sidewall, the tunnel boring machine comprising:

rotatable cutting wheel means for engaging the tunnel face and removing material therefrom to elongate the tunnel during a cutting stroke, said cutting wheel means having a central axis of rotation positioned substantially coaxially with the forward portion of the tunnel central longitudinal axis;

cutting wheel drive means operatively associated with said cutting wheel means for rotating said cutting wheel means about said central axis of rotation;

elongate central thrust arm means operably connected to said cutting wheel means for urging said cutting wheel means against the tunnel end face during a cutting stroke, said central thrust arms means having a central longitudinal axis substantially coaxial with said central axis of rotation of said cutting wheel means;

elongate cylinder means having a forward end positioned proximal said tunnel end face and a rear end positioned distal said tunnel end face for supporting said central thrust arm means in laterally and transversely non-displaceable, longitudinally sliding relationship therewithin, said elongate cylinder means having a central longitudinal axis positioned substantially coaxially with said thrust arm means central longitudinal axis and said cutting wheel means central axis of rotation, said thrust arm means being thrustingly extendable from said elongate cylinder means along said cylinder means central longitudinal axis during a cutting stroke and being retractable along said cylinder means central longitudinal axis between cutting strokes for advancing said cylinder means toward said cutting wheel means between cutting strokes;

rear end anchoring and positioning means operably connected to a rear end portion of said elongate cylinder means for selectively grippingly engaging the peripheral sidewall of the tunnel whereby axial rearward movement of said elongate cylinder means relative the tunnel sidewall during a cutting stroke is prevented, said rear end anchoring and positioning means being selectively disengageable from the tunnel sidewall after the completion of a cutting stroke for allowing forward movement of said elongate cylinder means between cutting strokes, said rear end anchoring and positioning means being adjustable for adjustably positioning a predetermined rear end pivot point located on said cylinder means central longitudinal axis into substantially conincidental relationship with the central longitudinal axis of the tunnel prior to the beginning of a cutting stroke;

pivotal means for pivotally connecting said rear end anchoring and positioning means with said rear end portion of said elongate cylinder means for providing a first rear end pivot axis conincident with said predetermined rear end point said elongate cylinder means being pivotal about said first rear end pivot axis during a laterally curved cutting stroke, the position of said first rear end pivot axis being fixed relative said rear end anchoring and positioning means, said first rear end pivot axis being stationary relative the tunnel sidewall during a curved cutting stroke and during a linear cutting stroke; and forward lateral positioning means for selectively laterally displacing a front end portion of said cylinder means for pivoting said elongate cylinder means about said first rear end pivot axis during a laterally curved cutting stroke and for maintaining said elongate cylinder means in non-pivoting relationship about said first rear end pivot axis during a linear cutting stroke.

3. The invention of claim 2 wherein said rear end anchoring and positioning means comprises a pair of opposite laterally extendable and retractable rear arm means, said opposite rear arm means being coaxial with a rear arm axis intersecting said elongate cylinder means central longitudinal axis and said first rear end pivot axis at said rear end pivot point.

4. The invention of claim 3 wherein said rear end anchoring and positioning means further comprises:

rear gripping pad means universally swivelly mounted at outer ends of said extendable and retractable rear arm means for grippingly engaging the tunnel wall; wherein said gripping pad means are universally pivotally mounted on said rear arm means substantially coincident with said rear arm axis, whereby said rear arm axis defines a second rear end pivot axis of said elongate cylinder means, said elongate cylinder means being pivotal about said second rear end pivot axis during a transversely curved cutting stroke, said second rear end pivot axis being stationary relative the tunnel sidewall during a curved cutting stroke and during a linear cutting stroke.

5. The invention of claim 4 wherein said rear end anchoring and positioning means comprises:

rear arm adjusting means for pivotaing said rear arm means about said first rear pivot axis during a disengaged state between cutting strokes for placing said rear arm means in substantially perpendicular relationship with the tunnel longitudinal axis prior to engaging the tunnel sidewall.

6. The invention of claim 4 further comprising forward transverse positioning means for selectively transversely displacing a forward portion of said cylinder means, for pivoting said elongate cylinder means about said second rear end pivot axis during a transversely curved cutting stroke.

7. The invention of claim 2 wherein said rear end anchoring and positioning means comprises:

rear transverse positioning and support means for transversely positioning said predetermined rear end pivot point of said elongate cylinder means in substantially coincidental relationship with said tunnel central longitudinal axis prior at the beginning of a cutting stroke and for rollingly supporting a rear end portion of said elongate cylinder means between cutting strokes.

8. The invention of claim 2 wherein said elongate cylinder means comprises torque resistance means operably associated with said elongate thrust rod means for preventing rotation of said elongate thrust rod means.

9. The invention of claim 2 wherein said elongate cylinder means comprises fluid chamber means therewithin for transmitting force to said thrust rod means for extending and retracting said thrust rod means from said elongate cylinder means.

10. The invention of claim 2 wherein said machine has a total axial length with said elongate central thrust rod means in a retracted position, approximately equal to the length of a cutting stroke plus the axial length of said cutting wheel means.

* * * * *